US011761641B2

(12) United States Patent
Ardha et al.

(10) Patent No.: US 11,761,641 B2
(45) Date of Patent: Sep. 19, 2023

(54) HEAT PUMP SYSTEMS

(71) Applicant: Rheem Manufacturing Company, Atlanta, GA (US)

(72) Inventors: Vishwanath Ardha, Montgomery, AL (US); Saman Beyhaghi, Montgomery, AL (US); Hongchu Chen, Montgomery, AL (US); David Gibbons, Prattville, AL (US); Prudhvi Vishnu vardhan Amaravadhi, Montgomery, AL (US)

(73) Assignee: Rheem Manufacturing Company, Atlanta, GA (US)

( * ) Notice: Subject to any disclaimer, the term of this patent is extended or adjusted under 35 U.S.C. 154(b) by 0 days.

(21) Appl. No.: 17/160,975

(22) Filed: Jan. 28, 2021

(65) Prior Publication Data

US 2022/0235944 A1 Jul. 28, 2022

(51) Int. Cl.
*F24D 3/18* (2006.01)
*F24D 19/08* (2006.01)

(52) U.S. Cl.
CPC ..... *F24D 3/18* (2013.01); *F24D 19/082* (2013.01)

(58) Field of Classification Search
CPC ..... F24D 3/18; F24D 19/082; F24D 2200/12; F24D 2200/04; F24D 5/02; F25B 30/06; F25B 2400/01; Y02B 30/12; Y02B 30/52; F24H 4/02; F24H 9/0068
See application file for complete search history.

(56) References Cited

U.S. PATENT DOCUMENTS

| | | | | |
|---|---|---|---|---|
| 2,310,828 A * | 2/1943 | Back | F23L 17/10 454/115 |
| RE28,343 E * | 2/1975 | Castillo | F24F 3/001 62/50.7 |
| 2011/0058795 A1* | 3/2011 | Kleman | F24H 4/04 62/238.7 |
| 2017/0284702 A1* | 10/2017 | Boros | F24H 4/02 |
| 2018/0017286 A1* | 1/2018 | Bailey | F24H 4/04 |
| 2018/0252433 A1* | 9/2018 | Kraft | F28F 1/08 |
| 2019/0128565 A1* | 5/2019 | Pugh | F24H 9/02 |

* cited by examiner

*Primary Examiner* — Frantz F Jules
*Assistant Examiner* — Martha Tadesse
(74) *Attorney, Agent, or Firm* — Eversheds Sutherland (US) LLP

(57) ABSTRACT

Disclosed herein are heat pump systems for water heaters. The heat pump systems can comprise a housing defining an interior chamber, an air inlet, and an air outlet. The air inlet and the air outlet can form an air flow path through the interior chamber, and an evaporator unit can be positioned within the interior chamber such that the air flow path contacts the evaporator unit. The housing can also have a flue pipe having a cross-section to encourage aerodynamic flow and/or side baffles to encourage air flow into the evaporator unit. The housing can also have a second air inlet to increase air flow and a curved elbow around the first air inlet to direct the air flow path. The air flow path can flow from a top side of the housing to a side of the housing, and the air flow path can be reversible.

17 Claims, 10 Drawing Sheets

HEAT PUMP SYSTEMS

FIELD OF THE DISCLOSURE

The present disclosure relates generally to heat pump systems and, in particular, to air flow paths for heat pump systems.

BACKGROUND

Decreasing the energy consumption of water heaters can have a large impact on the energy usage of an overall household or other building. Some studies have found the water heater to be the second-most energy consuming appliance in a typical household, trailing only the heating and air conditioning system in the home. Particularly in heat pump water heater systems, increasing the heat transfer coefficient of the heat exchangers is desirable because increased efficiency of the heat pump will lead to increased efficiency of the overall water heater. When ambient air enters the heat pump to exchange heat with a thermal working fluid, a large portion of the heat transfer efficiency can be lost due to maldistribution of air (e.g., uneven distribution of air across the heat exchanger). Air recirculation and general turbulent flow can reduce the contact area of the heat exchanger that is available for heat transfer, thus reducing the heat transfer coefficient and efficiency of the system.

What is needed, therefore, are heat pump units that improve the quality and the volume of a flow of ambient air entering the heat pump to improve the heat transfer coefficient of the heat pump. The present disclosure addresses this need as well as other needs that will become apparent upon reading the description below in conjunction with the drawings.

BRIEF SUMMARY

The present disclosure relates generally to heat pump systems and, in particular, to air flow paths for heat pump systems.

The disclosed technology can include a heat pump system for a water heater. The heat pump system can comprise a housing defining an interior chamber, an air inlet, an air outlet, and an evaporator unit within the interior chamber. Air entering the interior chamber can transfer heat to the evaporator unit before flowing out of the air outlet. The air inlet can be included in a top pan which defines a top side of the interior chamber. The top pan can be configured to engage a top end of the heat pump system. The air outlet can be positioned on a side of the heat pump system. The air outlet can be configured such that an air flow path extends between the air inlet and the air outlet. The evaporator unit can be positioned in the air flow path, thereby creating a cross flow across the evaporator unit. The air flow path can be reversible, such that the air inlet is positioned on a side of the heat pump system and the air outlet is positioned on a top side of the interior chamber.

The heat pump system can also include a flue pipe positioned in the air flow path. The flue pipe cross-section can have a leading edge, a trailing edge, and a central portion between the leading edge and the trailing edge. A width of the leading edge can be less than or equal to a width of the central portion. The flue pipe can have an elliptical cross-section, wherein a major axis of the elliptical cross-section is parallel to the air flow path. The interior chamber can also be partitioned into a first interior chamber and a second interior chamber being fluidly separated, and the flue pipe can be positioned in the second interior chamber separate from the air flow path in the first interior chamber.

The heat pump system can also comprise side baffles positioned between the evaporator unit and the housing. Each of the side baffles can be disposed at an angle such that the side baffles direct the air flow path to the evaporator unit. Alternatively, or additionally, the air inlet can be a first air inlet and the housing can further comprise a second air inlet in fluid communication with the air flow path. The second air inlet can be positioned proximate to one of the side baffles to encourage air flow from the second air inlet to the air flow path.

The heat pump system can further include a curved elbow attached to the air inlet to direct the air flowing therethrough to the evaporator unit.

The disclosed technology can also include heat pump systems comprising a housing. The housing can have an internal volume and a partition defining a first interior chamber and a second interior chamber within the internal volume. The first interior chamber and the second interior chamber can be fluidly separated. The first interior chamber can also have an air inlet, and air outlet, and an air flow path extending therebetween. The heat pump system can also include an evaporator unit positioned at least partially in the air flow path in the first interior chamber. The evaporator unit can be curved thereby increasing a surface area of the evaporator unit exposed to the air flow path. The evaporator unit can be concave relative to the air flow path.

The disclosed heat pump systems can also comprise a condenser unit, a compressor, and a thermal expansion valve, all of which can form a fluid circuit. The fluid circuit can flow a heat transfer fluid therethrough.

These and other aspects of the present disclosure are described in the Detailed Description below and the accompanying figures. Other aspects and features of examples of the present disclosure will become apparent to those of ordinary skill in the art upon reviewing the following description of specific examples of the present disclosure in concert with the figures. While features of the present disclosure may be discussed relative to certain examples and figures, all examples of the present disclosure can include one or more of the features discussed herein. Further, while one or more examples may be discussed as having certain advantageous features, one or more of such features may also be used with the various examples of the disclosure discussed herein. In similar fashion, while examples may be discussed below as device, system, or method examples, it is to be understood that such examples can be implemented in various devices, systems, and methods of the present disclosure.

BRIEF DESCRIPTION OF THE DRAWINGS

The accompanying drawings, which are incorporated in and constitute a part of this specification, illustrate multiple examples of the presently disclosed subject matter and serve to explain the principles of the presently disclosed subject matter. The drawings are not intended to limit the scope of the presently disclosed subject matter in any manner.

DETAILED DESCRIPTION

Figure 1:
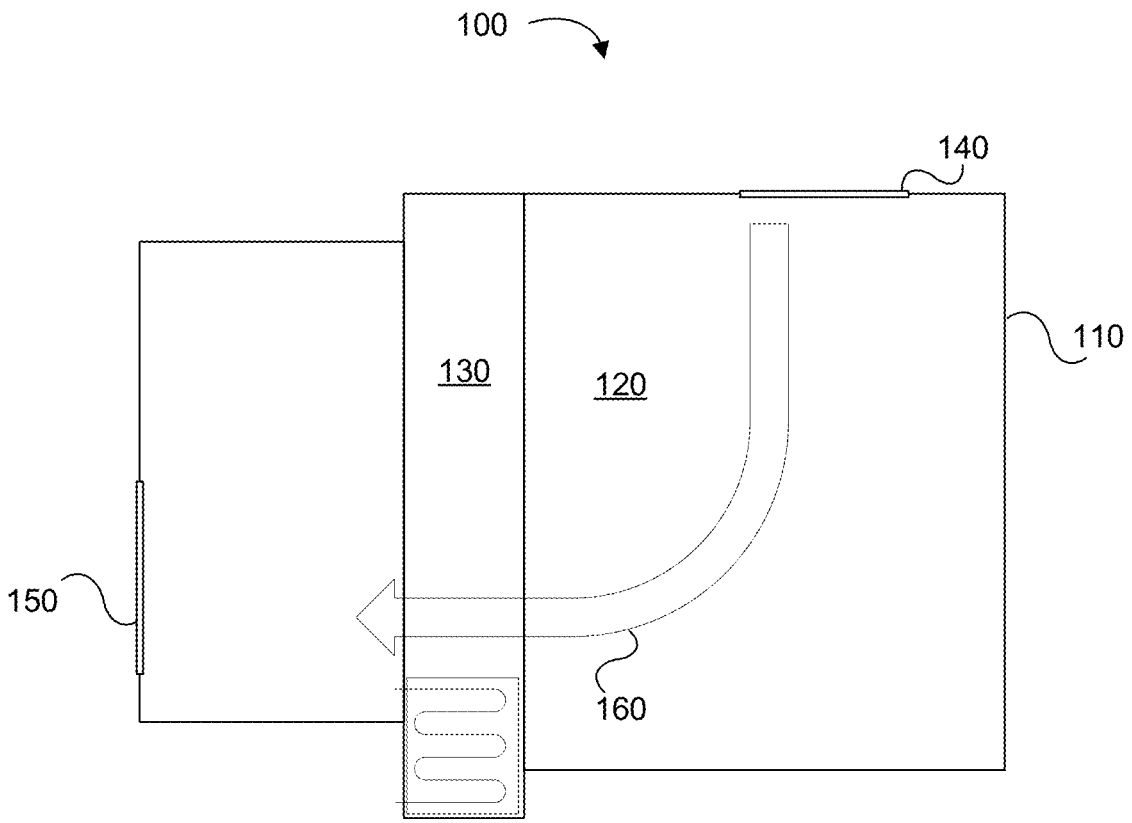
FIG. 1 illustrates a side cross-sectional view of a heat pump system in accordance with the present disclosure.

As described above, a problem with current water heaters is that ambient air flowing through heat pump systems, such as in the evaporator unit, is not evenly distributed across the heat exchanger. The fluid dynamics of current air flow paths tend to cause turbulent and/or obstructed flow, air recirculation, vortices, and other disruptive flow patterns. As a result, the amount of air contacting the heat pump working fluid is typically uneven, ineffective, or both. This can reduce the heat transfer coefficient of the heat exchanger and the overall efficiency of the heat pump, causing the system to waste additional time and energy to provide the necessary heat transfer.

Disclosed herein are heat pump systems comprising a housing defining an interior chamber, an air flow path extending through the interior chamber from an air inlet to an air outlet, and a heat exchanger (e.g., an evaporator unit) positioned in the air flow path. The heat exchanger can interact with the air flowing through the air flow path and across the heat exchanger to conduct a heat exchange between the air and a thermal working fluid flowing through an internal portion of the heat exchanger. If a flue pipe is also positioned in the air flow path, the flue pipe can have a shape (e.g., elliptical shape) to improve the aerodynamic flow around the flue pipe (e.g., a foil). The heat pump system can include side baffles to angle and direct air flow toward the heat exchanger, and/or the air inlet can include or be located proximate a curved elbow for similar reasons. Alternatively or in addition, the interior chamber can include one or more secondary air inlets leading into the air flow path to increase the air flow rate through the heat pump systems. These secondary air inlets can be located on or near the side baffles. Optionally, the air flow path can be partitioned away from other components of the heat pump system (e.g., the flue pipe) so that there are no obstructions in the air flow path (or a limited or reduced number thereof). The air inlet can be positioned on a top of the interior chamber, and the air outlet can be positioned on a side of the interior chamber, or vice versa.

While the present disclosure is described relating to heat pump systems for water heaters and evaporators for heat pump systems, it is understood that the technology described herein is not so limited. Indeed, unless otherwise explicitly stated, the present disclosure can be used in conjunction with any heat transfer unit configured to transfer latent heat (e.g., an evaporator or a condenser), sensible heat (a heat exchanger, a heater, or a chiller), or both from air to another working fluid. Additionally, unless otherwise explicitly stated, the present disclosure is not limited to use in water heating applications and can be used in heat pumps for any application.

Although certain examples of the disclosure are explained in detail, it is to be understood that other examples and applications are contemplated. Accordingly, it is not intended that the disclosure is limited in its scope to the details of construction and arrangement of components set forth in the following description or illustrated in the drawings. Other examples of the disclosure are capable of being practiced or carried out in various ways. Also, in describing the disclosed technology, specific terminology will be resorted to for the sake of clarity. It is intended that each term contemplates its broadest meaning as understood by those skilled in the art and includes all technical equivalents which operate in a similar manner to accomplish a similar purpose.

Herein, the use of terms such as "having," "has," "including," or "includes" are open-ended and are intended to have the same meaning as terms such as "comprising" or "comprises" and not preclude the presence of other structure, material, or acts. Similarly, though the use of terms such as "can" or "may" are intended to be open-ended and to reflect that structure, material, or acts are not necessary, the failure to use such terms is not intended to reflect that structure, material, or acts are essential. To the extent that structure, material, or acts are presently considered to be essential, they are identified as such.

By "comprising" or "containing" or "including" is meant that at least the named compound, element, particle, or method step is present in the composition or article or method, but does not exclude the presence of other compounds, materials, particles, method steps, even if the other such compounds, material, particles, method steps have the same function as what is named.

It is also to be understood that the mention of one or more method steps does not preclude the presence of additional method steps or intervening method steps between those steps expressly identified.

The components described hereinafter as making up various elements of the disclosure are intended to be illustrative and not restrictive. Many suitable components that would perform the same or similar functions as the components described herein are intended to be embraced within the scope of the disclosure. Such other components not described herein can include, but are not limited to, for example, similar components that are developed after development of the presently disclosed subject matter.

Reference will now be made in detail to examples of the disclosed technology, some of which are illustrated in the accompanying drawings. Wherever convenient, the same references numbers will be used throughout the drawings to refer to the same or like parts.

FIG. 1 illustrates a cross-sectional component diagram of a heat pump system 100 for a water heater. As shown, the heat pump system 100 can comprise a housing 110. The housing 110 can include a top pan of a water heater. The housing 110 can be of various sizes and can define an interior chamber 120 inside of which certain components of the heat pump system 100 (or the water heater) can be housed. One such component housed within the interior chamber 120 can include an evaporator unit 130. The evaporator unit 130 can be a heat exchanger configured to conduct a heat exchange between air in the interior chamber 120 and a working fluid flowing through the evaporator unit 130. The heat exchanged by the evaporator unit 130 can be latent heat (e.g., heat to change the phase of working fluid from liquid to vapor), sensible heat (e.g., heat to change the temperature of the working fluid), or a combination thereof.

The heat pump system 100 can have an air inlet 140 which can be an aperture in the housing 110 allowing air to flow from the external environment into the interior chamber 120. The evaporator assembly 100 can also include an air outlet 150, which can be another aperture in the housing 110 allowing air to flow out of the interior chamber 120. The air outlet 150 can guide egress of the air back to the external environment or into another chamber, another component of the water heater, or some other location.

The air inlet 140 can be positioned on a top side of the heat pump system 100, as shown. Such a top side can be referred to as a "top pan" that engages the heat pump system 100. The top pan can also define the top side of the interior chamber 120 (or a portion thereof) if the top side is not already defined by the housing 110. The air outlet 150 can be positioned on a side of the heat pump system 100, as shown. Alternatively, the air inlet 140 can be positioned on a side of the heat pump system 100, and the air outlet can be positioned on a top side of the heat pump system; in such a manner, the air flow from the air inlet 140 to the air outlet 150 can be reversed.

The air inlet 140 and the air outlet 150 can form an air flow path 160 extending therebetween along which air entering the heat pump system 100 flows from the air inlet 140 to the air outlet 150. The evaporator unit 130 can be positioned within the air flow path 160 to ensure that flowing air contacts the evaporator unit 130 to transfer heat. Increasing the average velocity along the air flow path 160, and therefore across the heat exchanger, can increase the Reynolds number of the air in contact with the evaporator unit 130. Without wishing to be bound by any particular scientific theory, increasing the Reynolds number of the air in contact with the evaporator unit 130 can increase the heat transfer coefficient of the evaporator unit 130.

Alternatively, if the air along the air flow path 160 is disrupted or uneven, the Reynolds number will decrease, thus decreasing the heat transfer coefficient of the evaporator unit 130. While uneven flow may result in higher local air velocities in certain locations along the evaporator unit 130, due to turbulence and air recirculation, others locations along the evaporator unit 130 can receive very little air flow and/or air flow having a low local air velocity, resulting in the total average air velocity along the evaporator unit 130 being lower than the higher local air velocities. Thus, there is an opportunity for improvement in the heat transferability of evaporator units in heat pumps. It is desirable to improve the air velocity distribution to thereby increase the Reynolds number of the air contacting the evaporator unit, as shown in Equation 1:

$$Re = \frac{\rho u L}{\mu} = \frac{uL}{v} \tag{1}$$

where Re is the Reynolds number, ρ is the fluid density, u is the fluid flow speed, L is the characteristic length, μ is the dynamic viscosity of the fluid, and v is the kinematic viscosity of the fluid.

Consequently, because the average heat transfer coefficient also has a proportional relationship with the rate of heat transfer ($\dot{Q}$) as shown in Equation 2, it follows that increasing the Reynolds number of the air flow path 160 can also increase the rate of heat transfer of the evaporator unit 130.

$$(\dot{Q}) = hA\Delta T \tag{2}$$

As shown, $\dot{Q}$ represents the heat transfer rate, h represents the average heat transfer coefficient, and ΔT represents the temperature difference of the air between the air inlet 140 and the air outlet 150. Additionally, as illustrated by Equation 4, the rate of heat transfer of the evaporator unit 130 can also be increased by increasing the heat transfer area (A). The heat transfer area can decrease if the air flow path 160 comprises flow disruptions, such as recirculation or vortices.

Figure 2A:
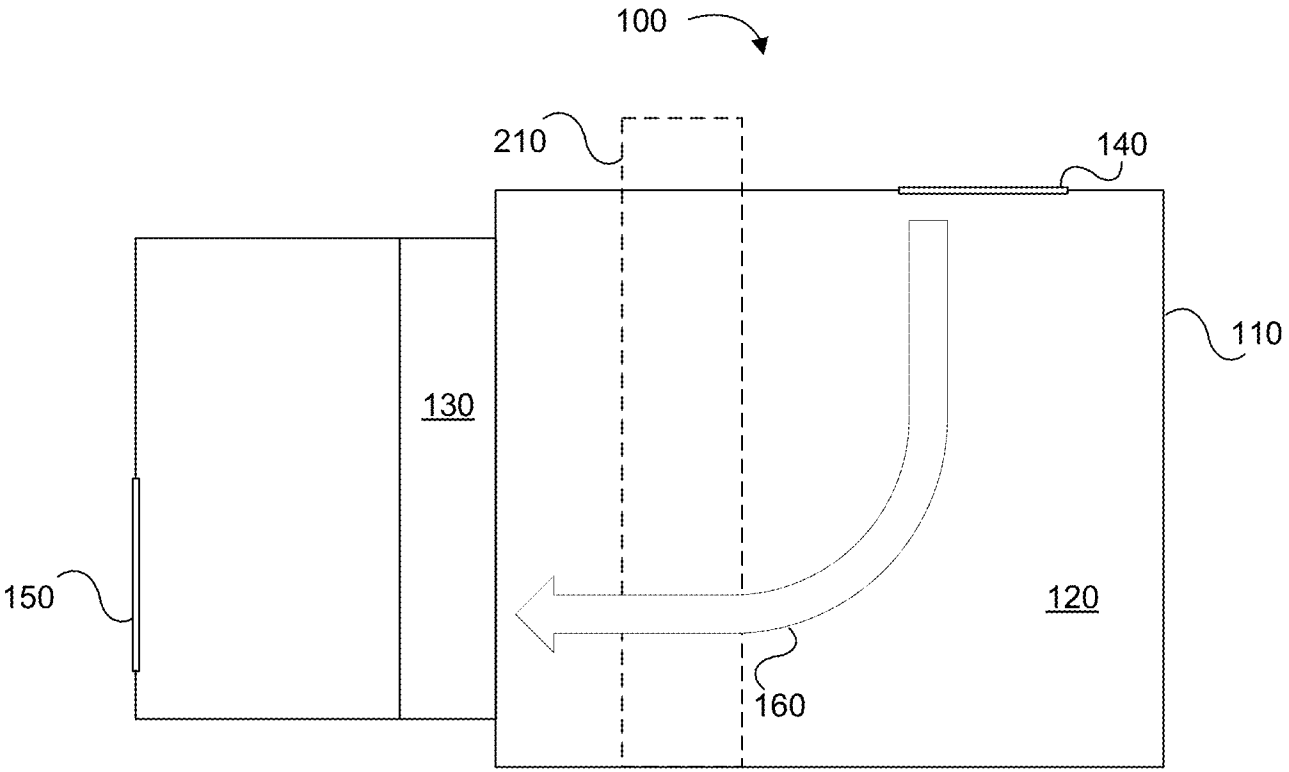
FIG. 2A illustrates a side cross-sectional view of a heat pump system in accordance with the present disclosure.

FIG. 2A illustrates another cross-sectional component diagram of the heat pump system 100. As shown, the heat pump system 100 can further comprise a flue pipe 210 positioned in the air flow path 160. The flue pipe 210 can transport spent combustion gases from a gas-type water heater to a vent or other components of a water heater. As would be appreciated, the presence of the flue pipe 210 in the air flow path can cause a major air obstruction and disruption to air en route to the evaporator unit 130. Additionally, the flue pipe 210 can be simply positioned within the housing 110, rather than specifically in the air flow path 160. The flue pipe 210 can be in any position as desired to transport the spent combustion gases out of the water heater. For example, the flue pipe 210 can extend from a bottom side of the housing 110 to a top side (e.g., a top pan) of the housing 110. In such an example, the flue pipe 210 can extend through the interior chamber 120, the air flow path 160, both, or neither.

Figure 2B:
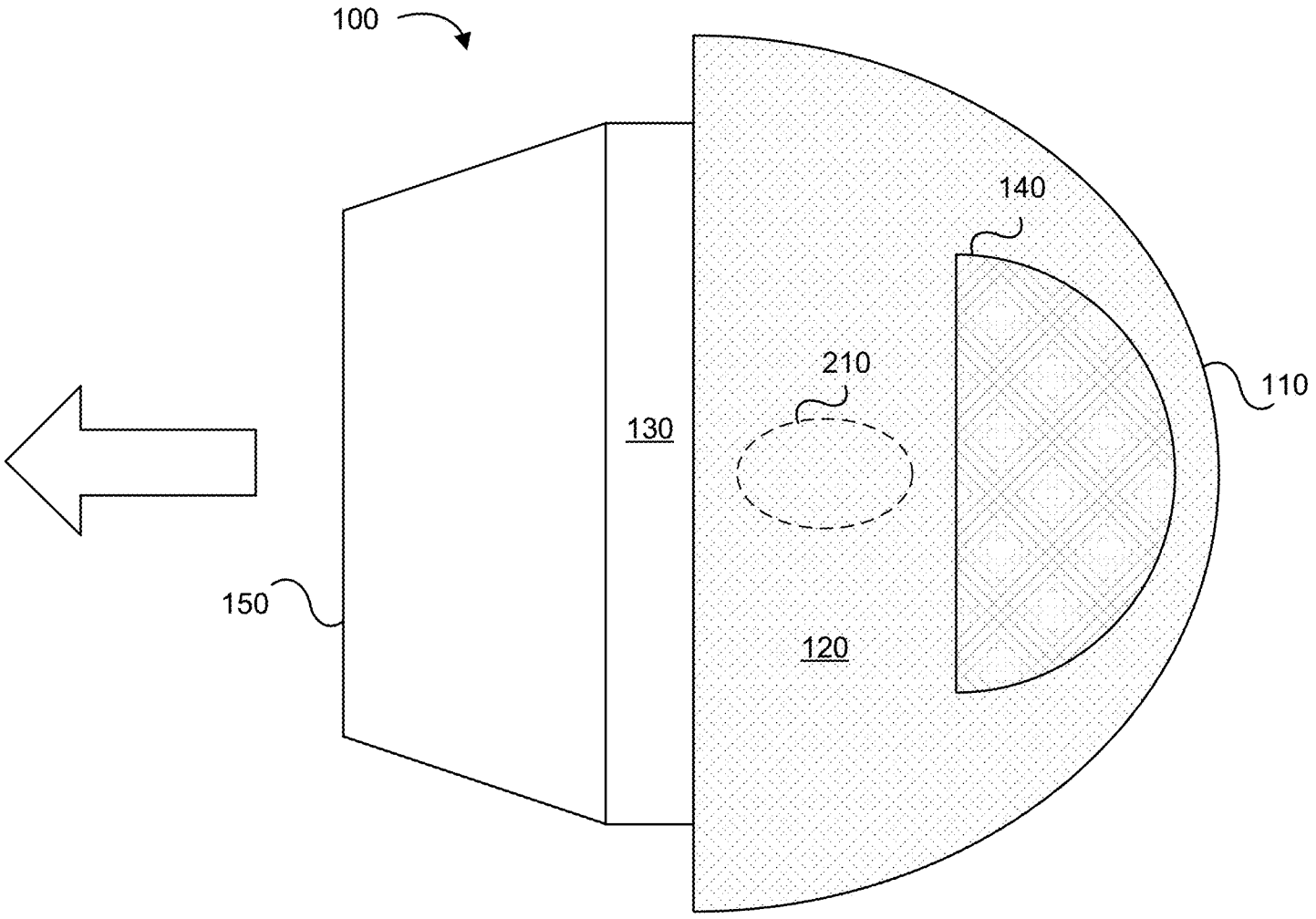
FIG. 2B illustrates a top-down cross-sectional view of the heat pump system of FIG. 2A in accordance with the present disclosure.
Figure 2C:
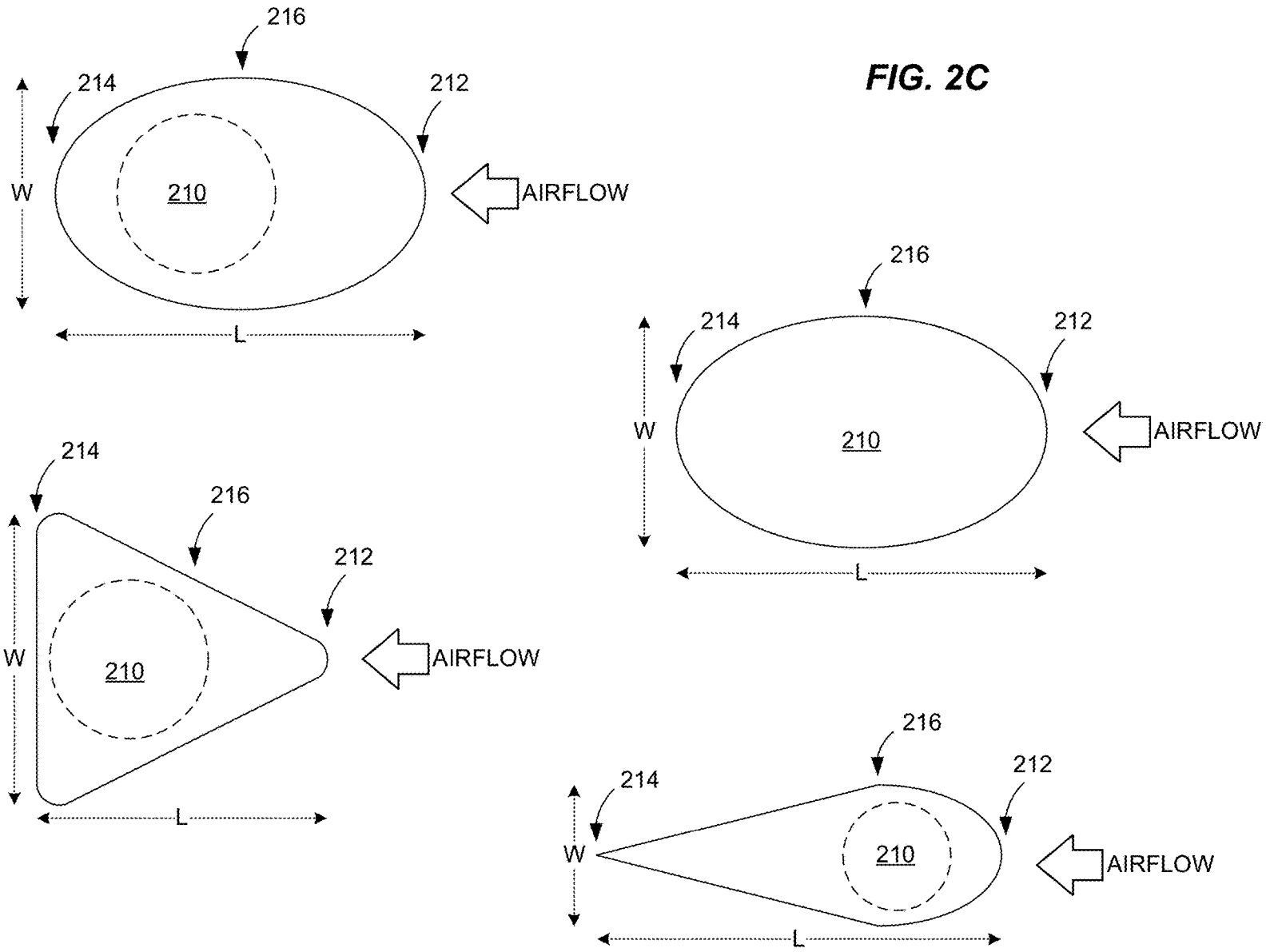
FIG. 2C illustrates additional top-down cross-sectional views of the flue pipe of FIG. 2B in accordance with the present disclosure.

As shown in the top-down view of FIG. 2B, however, the flue pipe 210 cross-section can have a leading edge, a trailing edge, and a central portion between the leading edge and the trailing edge. The flue pipe 210 cross-section can be or include a housing placed around the flue pipe 210, or the flue pipe 210 cross-section can be integral to (or defined by) the flue pipe 210 itself. Various examples of a flue pipe 210 cross-section having a leading edge 212, a trailing edge 214, and a central portion 216 are illustrated in greater detail in FIG. 2C. While certain examples are shown in FIG. 2C as having a flue pipe 210 located within a housing having a given flue pipe 210 cross-section, it is contemplated that the flue pipe 210 itself can have such a cross-sectional shape. A width of the leading edge can be less than or equal to a width of the central portion. For example, the flue pipe 210 can have an elliptical cross-section. Therefore, the major axis of the ellipse (e.g., the long side) can be oriented to be parallel to the air flow path 160. In such a manner, the flue pipe 210 can have a cross-sectional shape having increased aerodynamics, which can increase the smoothness and the velocity of the air flowing around the flue pipe 210 to the evaporator unit 130. As would be appreciated, and as described above, increasing the air flow and/or smoothness to the evaporator unit 130 can increase the Reynolds number and therefore the heat transfer coefficient of the evaporator unit 130. In the example of an ellipse, such a shape can position the major axis of the flue pipe 210 to be parallel to the air flow path 160, as generally illustrated in FIG. 2B, for example.

The flue pipe 210 can have other shapes, such as shapes that have a leading edge with a width that is less than a width of the central portion. Furthermore, such shapes can have a leading edge with a width that is equal to a width of the central portion. Alternatively or in addition, at least a portion of the flue pipe 210 can have a shape in which the length of that portion of the flue pipe (i.e., generally perpendicular to a central axis of the flue pipe and/or generally parallel to the air flow path) is greater than the width. Alternatively, or additionally, for at least a portion of the flue pipe, the length of the flue pipe cross section "L" can be greater than the width of the flue pipe "W" as shown in FIG. 2C. For instance, the flue pipe can be an oval, a geometric lens, a Vesica piscis lens, an asymmetrical lens, a triangle, a generally rounded triangle, an ellipse, a circle, a rounded quadrilateral, and the like.

Figure 3A:
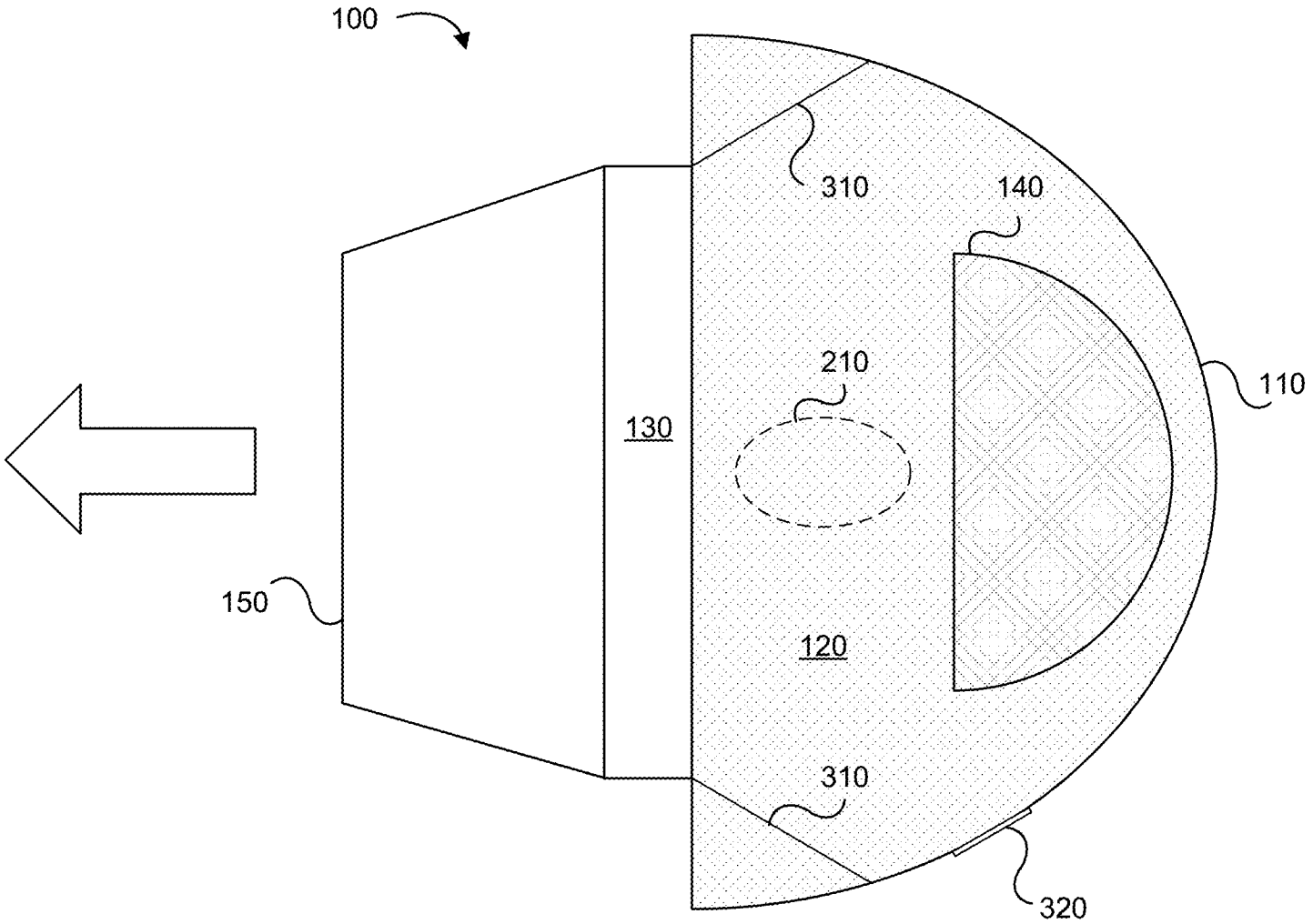
FIG. 3A illustrates a top-down cross-sectional view of a heat pump system in accordance with the present disclosure.

As shown in FIG. 3A, the heat pump system 100 can further comprise side baffles 310 angled toward the evaporator unit 130. The side baffles 310 can be positioned in the interior chamber 120 between the evaporator unit 130 and the housing 110 to cut off potential bypass routes to force the air to interact with the evaporator unit 130. Therefore, the side baffles 310 can increase the effective air flow rate in the air flow path 160 and the heat transfer coefficient of the evaporator unit 130. Although two side baffles 310 are illustrated in FIG. 3A, it is understood that any number of side baffles 310 can be positioned along the air flow path 160 to direct the air toward the evaporator unit 130.

The side baffles 310 are depicted as being located at either (or both) of the lateral ends of the evaporator unit 130. For example, as shown, each of the side baffles 310 can be angled from an outer wall of the interior chamber 120 toward an edge of the evaporator unit 130 to help direct air flow toward the evaporator unit and eliminate dead and/or recirculation areas adjacent to the evaporator unit 130. However, it is understood that the side baffles 310 can be similarly positioned above and/or below the evaporator unit 130 and angled upward and/or downward from a top or bottom of the interior chamber 120 to further direct air flow toward the evaporator unit 130. Indeed, the side baffles 310 can be positioned at any desirable angle to direct air flow into the evaporator unit 130.

Additionally, even though the side baffles 310 are depicted as rectangular, it should be understood that the side baffles 310 can take on any suitable shape to improve air flow into the evaporator unit 130. Indeed, the side baffles 310 can include fins, ridges, scallops, and other similar contouring to encourage smooth air flow over the side baffles 310. Additionally, the side baffles 310 themselves can be curved, angled, triangular, scooped, and other geometries to encourage air flow toward the evaporator unit 130.

Furthermore, the heat pump system 100 can include a secondary air inlet 320 in addition to the air inlet 140. The secondary air inlet 320 can include one or more apertures in the housing 110 in any position suitable to feed additional air into the air flow path 160. The secondary air inlet 320 can be positioned along the air flow path 160 (e.g., on a sidewall of the housing 110 at a position along the air flow path 160), or the secondary air inlet 320 can be positioned along the side baffles 310. As would be appreciated, if the secondary air inlet 320 was not along the air flow path 160, the side baffles 310 can help encourage air flow from the secondary air inlet 320 into either the air flow path 160 or the evaporator unit 130.

Figure 3B:
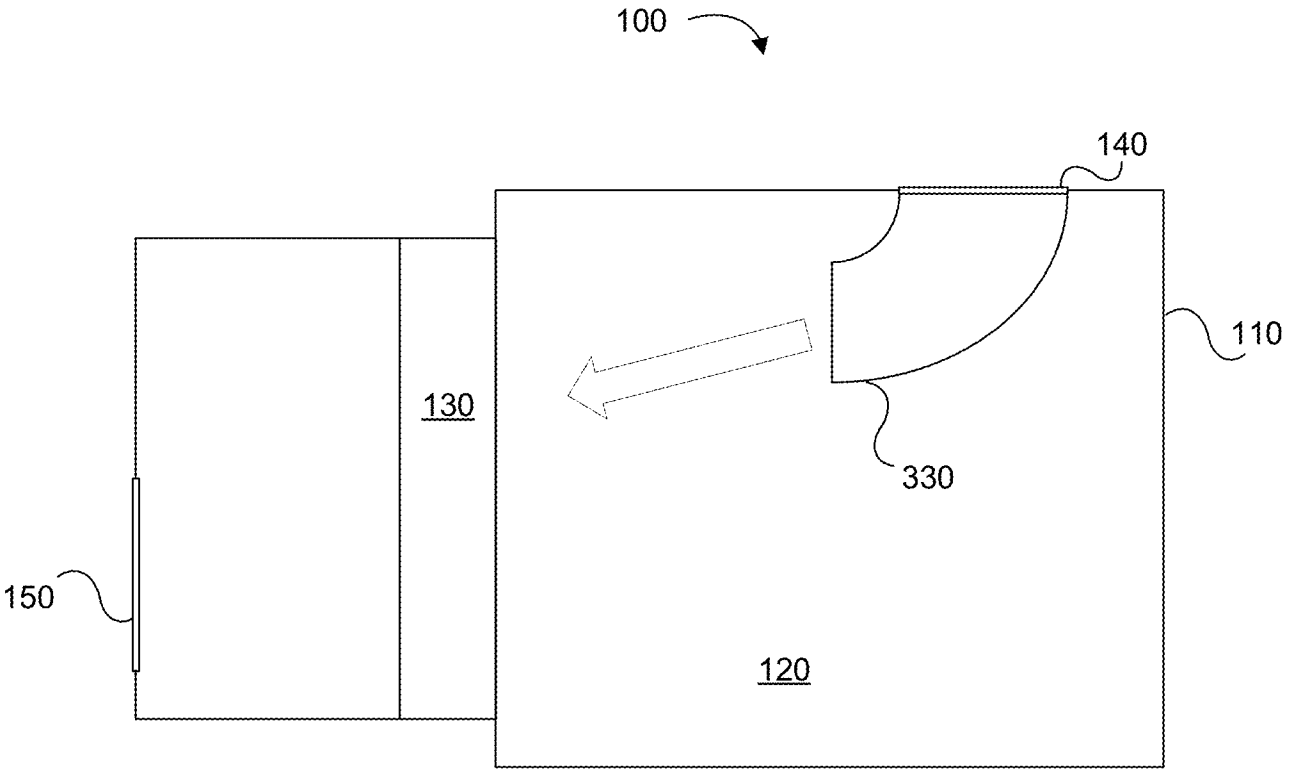
FIG. 3B illustrates a side cross-sectional view of heat pump system in accordance with the present disclosure.

While the secondary air inlet 320 is shown as being rectangular in cross-sectional shape in FIG. 3B, it is understood that the secondary air inlet 320 can be any shape. Similarly, while the air inlet 140 is depicted as being semicircular, it is understood that the air inlet 140 can be any shape. For instance, the secondary air inlet 320 and the air inlet 140 can be trapezoidal, pentagonal, triangular, or have any number of sides that need not be equidistant. Furthermore, the air inlet 140 and the secondary air inlet 320 can also be modified as desired to alter and/or finely tune air flow, such as with the inclusion of a variety of scallops, fins, waves, and the like. While FIG. 3A depicts a single secondary air inlet 320, it is contemplated that the heat pump system 100 can include two, three, four, or more secondary air inlets 320. The various secondary air inlets 320 can be located in any pattern or configuration, whether it be in a symmetrical configuration (e.g., two secondary air inlets 320 located on opposite sides of the heat pump system 100) or an asymmetrical configuration.

Alternatively, or additionally, the air inlet 140 can have a curved elbow 330, as shown in FIG. 3B. While the curved elbow 330 is illustrated as having an approximately 90-degree bend, the curved elbow 330 can direct incoming air in any desired direction. For example, the curbed elbow 330 can have a bend angle in a range between approximately 5 degrees and approximately 90 degrees. Thus, the curved elbow 330 can direct the air flow in any desired direction. For instance, it may be aerodynamically advantageous for the curved elbow 330 to direct air in an at least partially lateral direction (e.g., toward the side baffles 310).

Figure 4A:
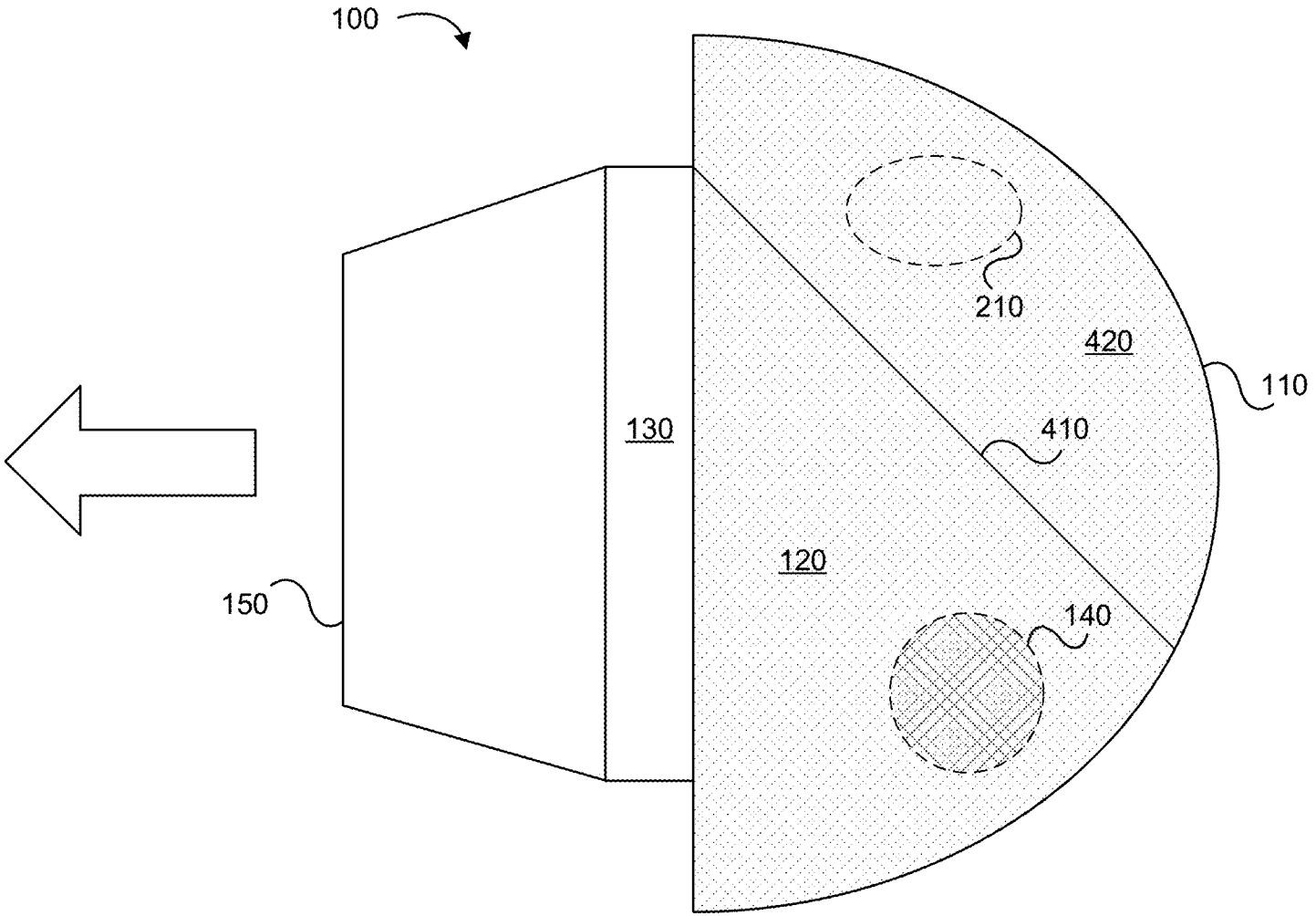
FIG. 4A illustrates a top-down cross-sectional view of a heat pump system in accordance with the present disclosure.

As shown in FIG. 4A, the housing 110 can include a partition 410. The partition 410 can divide the interior chamber 120 such that the housing 110 defines an interior chamber 120 (e.g., a first interior chamber) and a second interior chamber 420. The first interior chamber 120 and the second interior chamber 420 can be fluidly and/or thermally separated from one another. The first interior chamber 120 can operate largely the same as described above. The first interior chamber 120 can include the air inlet 140, the air outlet 150, the air flow path 160, and the evaporator unit 130 positioned between the air inlet 140 and the air outlet 150 along the air flow path 160. The second interior chamber 420, on the other hand, can house other components of the heat pump system 100, such as the flue pipe 210, and various valves, pipes, compressor, and/or pumps. In such a manner, the components of the heat pump system 100 in the second interior chamber 420 can be separated from the air flow path 160 such that the air flow path is substantially or completely unobstructed.

Figure 4B:
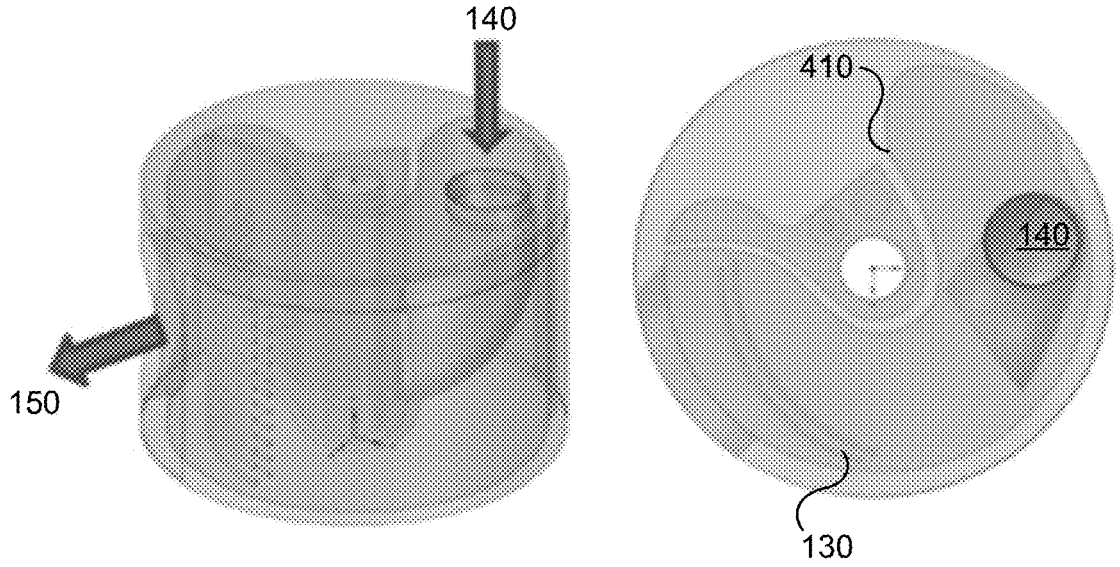
FIG. 4B illustrates an isometric and cross-sectional view of a heat pump system in accordance with the present disclosure.

The partition 410 can cause the interior chamber 120 and the second interior chamber 420 to be divided into a variety of shapes. For example, the partition 410 can divide the housing into two semicircles. Alternatively, the partition 420 can be curved in a U-shape such that the air flow path 160 in the first interior chamber 120 can bend around the second interior chamber 420, as shown in FIG. 4B. The partition 410 can also be a series of angled segments rather than a continuous curve. For example, the partition 410 can comprise a first segment, a second segment, and a third segment extending in a first direction, a second direction, and a third direction, respectively, such that the first, second, and third segments form a continuous air flow path 160 between the air inlet 140 and the air outlet 150.

In FIGS. 4A and 4B, or in any of the previously described figures, the evaporator unit 130 is illustrated and described as being rectangular and perpendicular to the air flow path 160. However, other positions, orientations, and geometries of the evaporator unit 130 are contemplated to be within the scope of the present disclosure. For example, the evaporator unit 130 can be positioned to be parallel to the air flow path 160 to increase the contact time with the flowing air. Alternatively, or additionally, the evaporator unit 130 can have a convex or a concave shape perpendicular to the air flow path 160 to increase the surface area of the evaporator unit 130.

Figure 5:
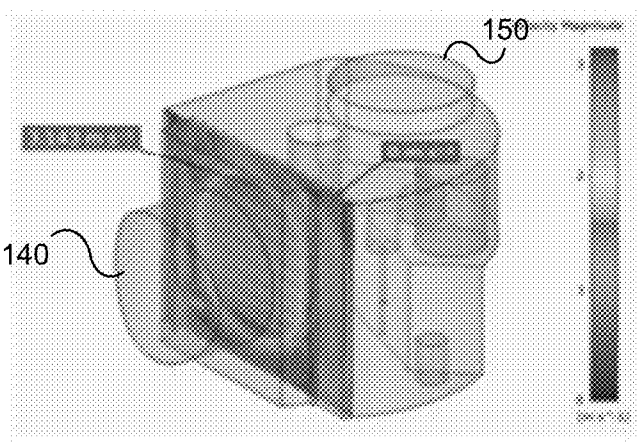
FIG. 5 illustrates the air flow distribution for different air flow paths in a heat pump system in accordance with the present disclosure.
Figure 5:
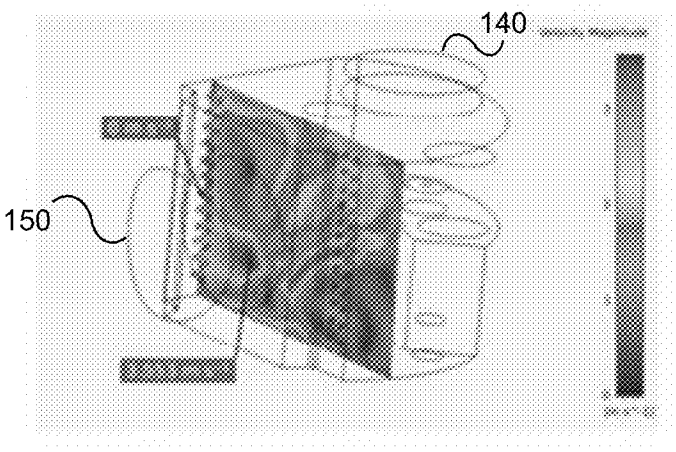

Furthermore, as described in reference to FIG. 1, the air inlet 140 and the air outlet 150 can be switched such that the air flow path 160 is reversed. A comparison between the "forward" air flow from FIG. 1 to the "reversed" air flow is shown in FIG. 5. As shown in FIG. 5, the air operating under a reversed air flow path 160 (e.g., the air inlet 140 is positioned on a side of the heat pump system 100, and the air outlet is positioned on a top side of the heat pump system), the quality and uniformity of the air contacting the evaporator unit 130 can be increased.

While the various designs in FIGS. 1-5 are described individually, it is understood that any of the designs described therein can be used alone or in any combination with one another. That is to say, the components presented in FIGS. 1-5 can be used individually or together with any heat pump system.

Figure 6:
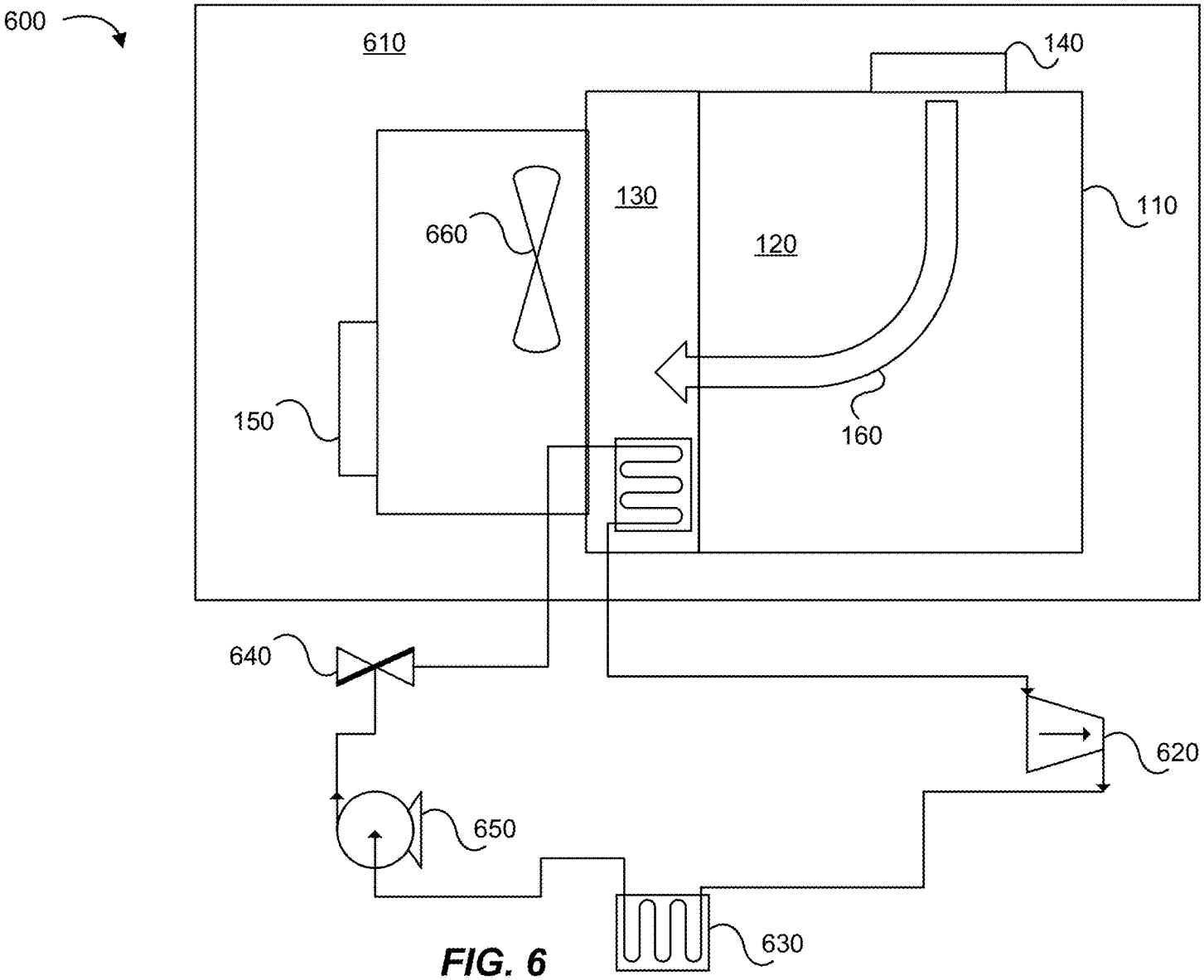
FIG. 6 illustrates a system diagram of a heat pump system in accordance with the present disclosure.

FIG. 6 illustrates another heat pump system 600. As shown, the heat pump system 600 can comprise an evaporator assembly 610 (including an evaporator unit 130), a compressor 620, a condenser assembly 630, and a thermal expansion valve 640. The evaporator assembly 610, the condenser assembly 630, the compressor 620, and the thermal expansion valve 640 can form a fluid circuit including various additional pipes, valves, and other fitments. The heat pump system 600 can also include components to encourage fluid flow along the fluid circuit, such as a pump 650, and the heat pump system 600 can also include components to encourage air flow, such as a fan 660. A heat transfer fluid can be configured to flow through the fluid circuit and undergo heat transfer at both the evaporator assembly 610 and the condenser assembly 630.

While the present disclosure has been described in connection with a plurality of example aspects, as illustrated in the various figures and discussed above, it is understood that other similar aspects can be used, or modifications and additions can be made to the described aspects for performing the same function of the present disclosure without deviating therefrom. For example, in various aspects of the disclosure, methods and compositions were described according to aspects of the presently disclosed subject matter. However, other equivalent methods or composition to these described aspects are also contemplated by the teachings herein. Therefore, the present disclosure should not be limited to any single aspect, but rather construed in breadth and scope in accordance with the appended claims.

What is claimed is:

1. A heat pump system for a water heater, the heat pump system comprising:

a housing defining an interior chamber having a first air inlet, a second air inlet, and an air outlet;

an air flow path in the interior chamber extending from the first air inlet and the second air inlet to the air outlet;

an evaporator unit positioned at least partially in the air flow path to interact with air flowing along the air flow path;

a first side baffle and a second side baffle positioned at a first and a second lateral end of the evaporator unit and along the air flow path, respectively, wherein the first side baffle and the second side baffle are disposed at an angle such that the first side baffle and the second side baffle are configured to direct air toward the evaporation unit, and wherein the second air inlet is proximate to the first side baffle; and a flue pipe positioned in the air flow path and defined by a flue pipe cross-section, the flue pipe cross-section having a leading edge, a trailing edge, and a central portion between the leading edge and the trailing edge, the flue pipe being oriented such that the leading edge is positioned in the air flow path at a location upstream of the central portion and the trailing edge, wherein (i) a width of the leading edge is less than or equal to a width of the central portion and (ii) for at least a portion of the flue pipe, a length of the flue pipe is greater than a width of the flue pipe, the length of the flue pipe being parallel to an air flow direction and the width of the flue pipe being perpendicular to the air flow direction, wherein the flue pipe extends from a bottom side of the housing through the interior chamber.

2. The heat pump system of claim 1, wherein at least a portion of the flue pipe has a cross-sectional shape that is elliptical, a major axis of the elliptical cross-section being parallel to the air flow path.

3. The heat pump system of claim 1 further comprising a curved elbow attached to the first air inlet and configured to direct the air flow path to the evaporator unit.

4. The heat pump system of claim 1 further comprising a top pan configured to engage a top end of the heat pump system, wherein the top pan comprises the first air inlet.

5. The heat pump system of claim 4, wherein the top pan defines a top side of the interior chamber.

6. The heat pump system of claim 1, wherein the first air outlet is positioned on a side of the heat pump system.

7. The heat pump system of claim 1, wherein the first air inlet is positioned on a side of the heat pump system and the air outlet is positioned on a top side of the interior chamber.

8. A heat pump system comprising:

a housing having an internal volume and a partition defining a first interior chamber and a second interior chamber within the internal volume, the first interior chamber and the second interior chamber being fluidly separated, the first interior chamber having a first air inlet, a second air inlet, and an air outlet;

an air flow path extending through the first interior chamber from the first air inlet and the second air inlet to the air outlet;

an evaporator unit positioned at least partially in the air flow path to interact with air flowing along the air flow path;

a side baffle positioned at a first end of the evaporator unit and along the air flow path, the side baffle disposed at an angle such that the side baffle directs the air flow path to the evaporator unit, wherein the second air inlet is proximate to the side baffle; and a flue pipe positioned in the second interior chamber such that the flue pipe is separated from the air flow path, the flue pipe having a cross-section having a leading edge, a trailing edge, and a central portion between the leading edge and the trailing edge, the flue pipe being oriented such that the leading edge is positioned in the air flow path at a location upstream of the central portion and the trailing edge, wherein (i) a width of the leading edge is less than or equal to a width of the central portion and (ii) for at least a portion of the flue pipe, a length of the flue pipe is greater than a width of the flue pipe, the length of the flue pipe being parallel to an air flow direction and the width of the flue pipe being perpendicular to the air flow direction.

9. The heat pump system of claim 8 further comprising a curved elbow attached to the first air inlet and configured to direct the air flow path to the evaporator unit.

10. The heat pump system of claim 8 further comprising a top pan configured to engage a top end of the heat pump system, wherein the top pan comprises the first air inlet.

11. The heat pump system of claim 10, wherein the top pan defines a top side of the first interior chamber.

12. The heat pump system of claim 8, wherein the air outlet is positioned on a side of the heat pump system.

13. The heat pump system of claim 8, wherein the first air inlet is positioned on a side of the heat pump system and the air outlet is positioned on a top side of the first interior chamber.

14. The heat pump system of claim 8, wherein the evaporator unit is curved thereby increasing a surface area of the evaporator unit exposed to the air flow path.

15. A heat pump system comprising:

a housing defining an interior chamber having a first air inlet, a second air inlet, and an air outlet;

an air flow path in the interior chamber extending from the first air inlet and the second air inlet to the air outlet;

an evaporator unit positioned at least partially in the air flow path to interact with air flowing along the air flow path;

side baffles between the evaporator unit and the housing, each of the side baffles being disposed at an angle such that the side baffles direct the air flow path to the evaporator unit, wherein the second air inlet is proximate to at least one of the side baffles; and a flue pipe extending from a bottom side of the housing through the interior chamber, the flue pipe positioned in the air flow path and defined by a flue pipe cross-section having a leading edge, a trailing edge, and a central portion between the leading edge and the trailing edge, wherein a width of the leading edge is less than or equal to a width of the central portion.

16. The heat pump system of claim 15, wherein the flue pipe is oriented such that the leading edge is positioned in the air flow path at a location upstream of the central portion and the trailing edge, wherein (i) a width of the leading edge is less than or equal to a width of the central portion and (ii) for at least a portion of the flue pipe, a length of the flue pipe is greater than a width of the flue pipe, the length of the flue pipe being parallel to an air flow direction and the width of the flue pipe being perpendicular to the air flow direction.

17. The heat pump system of claim 15 further comprising a curved elbow attached to the first air inlet and configured to direct the air flow path to the evaporator unit.

* * * * *